United States Patent [19]

Bianchi et al.

[11] 4,259,374

[45] Mar. 31, 1981

[54] METHOD OF PAINTING

[75] Inventors: Raymond A. Bianchi, Pekin; Sally L. Heathcoat, Peoria, both of Ill.

[73] Assignee: Caterpillar Tractor Co., Peoria, Ill.

[21] Appl. No.: 85,648

[22] PCT Filed: Apr. 27, 1979

[86] PCT No.: PCT/US79/00282

§ 371 Date: Apr. 27, 1979

§ 102(e) Date: Apr. 27, 1979

[87] PCT Pub. No.: WO 80/02390

PCT Pub. Date: Nov. 13, 1980

[51] Int. Cl.[3] ..... B05D 1/32

[52] U.S. Cl. ..... 427/282; 118/301; 118/504; 118/505; 427/421

[58] Field of Search ..... 427/282, 421; 118/505, 118/504, 301

[56] References Cited

U.S. PATENT DOCUMENTS

| | | | |
|---|---|---|---|
| 1,697,200 | 1/1929 | Morgan et al. | 118/505 |
| 1,799,913 | 4/1931 | Lemmons | 118/505 |
| 2,151,427 | 3/1939 | Houk | 427/282 |
| 2,922,392 | 1/1960 | Mund | 118/505 |
| 3,001,509 | 9/1961 | Carpenter et al. | 118/505 |

*Primary Examiner*—Ronald H. Smith
*Assistant Examiner*—Janyce A. Bell
*Attorney, Agent, or Firm*—Wegner, Stellman, McCord, Wiles & Wood

[57] ABSTRACT

A method of an apparatus for use in painting a wall surface (13) surrounding a panel (11). The method includes the step of providing a protector element (14) having a base portion (15) defining a periphery (24) at least as large as the periphery (18) of the panel (11). A second portion (17) of the protector element projects forwardly from the periphery of the base portion. A cover (21) is provided with a notch-type snap fastening portion cooperating with a complementary portion (19) of the protector element second portion (17) for removably securing the cover to the protector element so as to define therewith a shield for protecting the panel from overspray during the painting operation. Upon completion of the painting operation, the cover may be removed and the second portion (17) of the protector element removed from the protector element as by being cut therefrom as with a knife (23) leaving exposed only an edge (24) of the base portion (15) of the protector element which may be in substantial congruity with the periphery (18) of the panel. The protector element may be formed of an element having a color similar to that of the paint coating or that of the panel as desired so as to provide a visual continuation thereof.

20 Claims, 3 Drawing Figures

FIG. 1
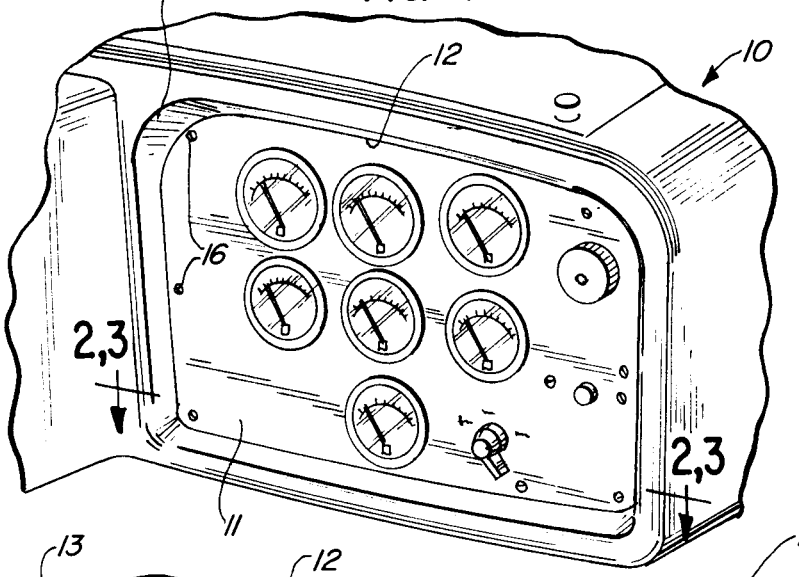
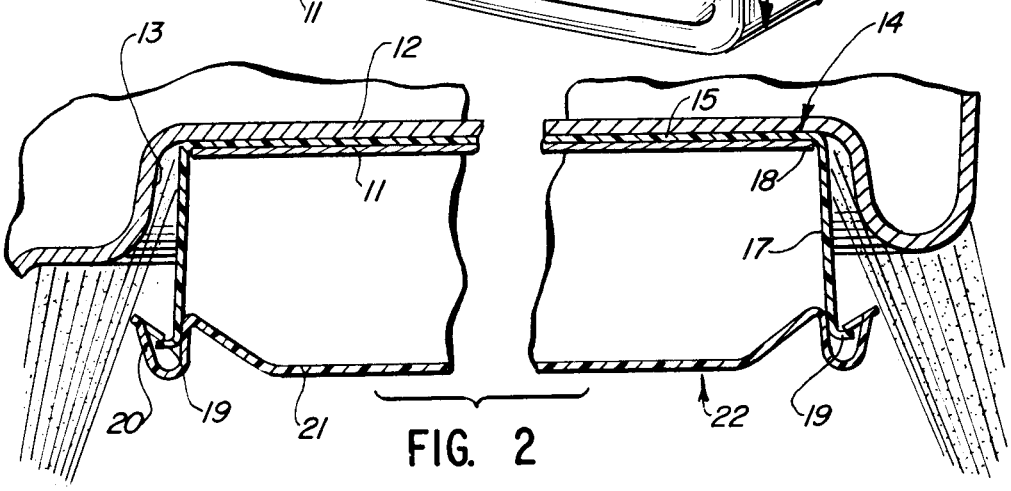
FIG. 2
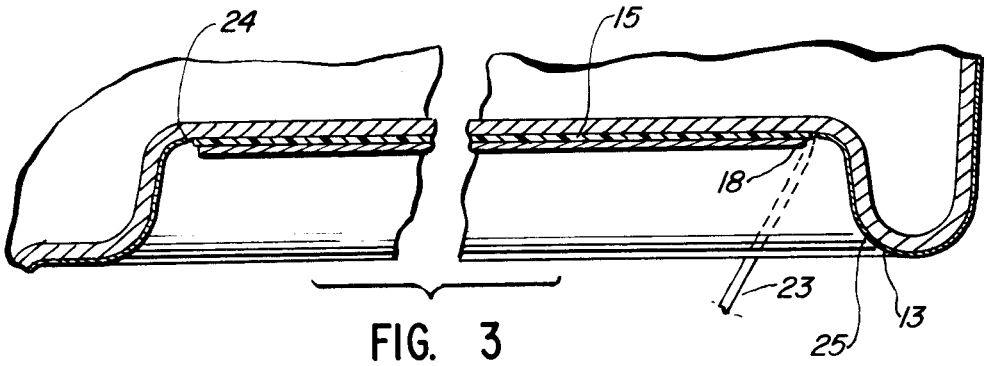
FIG. 3

METHOD OF PAINTING

Technical Field

This invention relates to painting of wall surfaces and in particular to a method of and apparatus for painting of wall surfaces surrounding areas which are to be left unpainted.

BACKGROUND ART

It is conventional in painting of wall surfaces, such as wall surfaces surrounding a panel or the like, as in the dashboard of a vehicle, to mask off the portions of the structure not intended to be painted so as to avoid inadvertent painting of the edge portions thereof during the painting of the wall surface portions intended to be painted.

This method of painting has the serious drawback of requiring time consuming and thus expensive application of the masking tape as the edge of the tape must accurately define the boundary of the painted surface area adjacent the area intended to be left unpainted.

Further, the removal of the tape may further require a cleaning up operation to assure removal of all adhesive. In certain instances where the tape is not accurately applied, some overpainting occurs requiring removal of that overpainted material from the area intended to be left unpainted and this is a further time consuming and expensive operation.

DISCLOSURE OF THE INVENTION

The present invention comprehends an improved process for effecting the painting of a wall surface surrounding an area to be left unpainted, such as that defined by a panel portion of a dashboard of a vehicle.

More specifically, the invention comprehends utilizing an improved protector element having a first, or base, portion installed behind the panel intended to be left unpainted and having a second portion projecting from the base portion arranged to prevent inadvertent painting of the edge portions of the panel during the painting of the panel.

In the illustrated embodiment of the invention, the second portion of the protector element projects substantially forwardly from the periphery of the first portion and a protective cover is removably installed on the forward end of the second portion of the protector element so as to effectively fully enclose the front surface of the panel during the painting operation.

In the illustrated embodiment, the painting operation may comprise a spray painting operation with the protector elements and cover cooperatively forming a shield preventing overspray onto the front surface of the panel during the painting operation.

The invention further comprehends that upon completion of the painting operation, the second portion of the protector element be removed together with the cover leaving the base portion of the protector element retained behind the panel. In the illustrated embodiment, the removal of the second portion is effected by a cutting operation.

The invention comprehends that during the cutting operation, the edge of the panel may be utilized as a guide to assure that the protector element is accurately cut in substantial congruency with the periphery of the panel.

The cutting operation may be effected subsequent to the drying of the previously applied paint, as desired.

The invention comprehends that the protector element may be formed of a material having a color similar to that of the paint applied to the surrounding wall surface so that upon removal of the second portion of the protector element, the exposed periphery of the first portion of the protector element will define a visual extension of the painted surface.

Alternatively, the protector element may be formed of material having a color similar to that of the panel periphery so that upon removal of the second portion, the periphery of the protector element first portion so exposed will be visually similar to that of the periphery of the panel.

In the illustrated embodiment, the cover is removably secured to the protector element as by a snap fitting connection.

In the illustrated embodiment, the protector element is formed of a relatively inexpensive material, such as synthetic resin.

Both the panel and the base portion of the protector element may be secured to the member defining the wall surface portion intended to be painted.

As shown in the illustrated embodiment, the panel may be recessed relative to the wall surface portion to be painted.

BRIEF DESCRIPTION OF THE DRAWING

FIG. 1 is a fragmentary perspective view of a portion of a vehicle dashboard having a painted wall surface surrounding a control panel, the wall surface having been painted by the improved method embodying the invention;

FIG. 2 is a fragmentary horizontal section taken substantially along the line 2—2 but with the protector element as constructed and arranged with respect to the panel during the painting operation; and FIG. 3 is a fragmentary horizontal section generally similar to that of FIG. 2 but showing the arrangement of the structure upon completion of the removal of the second portion of the protector element as by a knife cutting action. Best Mode for carrying out the invention In the exemplary embodiment of the invention as disclosed in the drawing, a dashboard 10 of a vehicle, such as a tractor vehicle, is shown to include an instrument panel 11 mounted within a recess portion 12 of the dashboard. Surrounding the panel, the dashboard defines a wall surface portion 13.

It is desirable in the manufacture of such a vehicle to permit the painting of the dashboard, and more specifically, the portion of the dashboard surrounding the panel, after the panel is installed such as to avoid scratching and other deformation of the painted surface as may occur during the assembly of the vehicle. As discussed above, the present invention comprehends an improved method of effecting such painting in a novel and economical manner which effectively prevents undesirable painting of the edge portions of the panel during the painting operation.

More specifically, as seen in FIGS. 2 and 3, the invention comprehends the provision of a protector element generally designated 14 having a base portion 15 mounted behind the panel 11. As shown in FIG. 1, the panel may be secured to the recess portion 12 of the dashboard as by suitable mounting screws 16.

Extending from the base portion 15 of the protector element is a second portion 17. In the illustrated embodiment, the second portion 17 extends forwardly from the flat plane of the base portion in surrounding relationship to the periphery 18 of the panel 11 so as to project forwardly from the wall surface 13 to be painted.

The forward edge portion 19 of the protector element portion 17 cooperates with a turned edge 20 of a cover element 21 to define a snap connection permitting readily removable but firmly secured mounting of the cover 21 to the protector element so as to define therewith a protective shield generally designated 22 enclosing the panel 11.

Thus, as seen in FIG. 2, the shield 22 effectively prevents paint from being applied to the panel 11 during the painting of the surrounding wall surface 13. As shown in FIG. 2, the painting may be effected by a spray painting which, while having some overspray applied to the outer surface of the protector element second portion 17, has no portion thereof applied to any portion of the panel 11. Resultingly, the uniform desired painting of the dashboard in the area defined by the wall surface 13 may be readily and easily effected by the standard spray painting techniques.

Upon completion of the painting operation, the cover 21 may be removed from the protector element permitting removal of the second portion 17 of the protector element as by a cutting of the second portion from the base portion 15 with a suitable instrument, such as knife 23 illustrated in phantom lines in FIG. 3. More specifically, the periphery 18 of the panel may be utilized as a guide in permitting the knife 23 to cut the protector element in substantial congruity with the periphery 18 of the panel so as to leave a neat, accurate exposed edge 24 of the cut base 15. As shown in FIG. 3, the paint coating 25 terminates at the cut edge 24 so as to provide a neat boundary of the applied paint relative to the panel and protector element base.

The invention further comprehends that the protector element be formed of a material having a cover which selectively may be the same as that of the paint coating 25 or that of the panel 11, as desired. Thus, the exposed edge 24 may comprise a visual extension of either the paint coating 25 or the panel 11, as desired.

In the illustrated embodiment, the protector element is formed of a low cost material, such as molded synthetic resin. In one illustrative embodiment of the invention, the spray painted coating 25 was bright yellow with the protector element being formed of a similarly colored yellow synthetic resin. The protector element was thermoformed from sheet stock material having a thickness of approximately 1 millimeter. The synthetic resin comprised a polyethylene homopolymer. The cover 21 was formed of a similar material.

The cutting of the protector element may be effected subsequent to a complete drying of the paint coating 25, if desired. However, as the cutting operation is effected from within the structure defined by the protector element portion 17, the cutting operation may be performed without affecting the coating 25, thus permitting the removal of the protector element portion 17 immediately upon completion of the spray painting operation, if desired.

INDUSTRIAL APPLICABILITY

As discussed above, the invention comprehends an improved method of and apparatus for painting a wall surface surrounding a panel or the like intended to be maintained free of the paint. In illustrating the invention, the process was disclosed as in conjunction with the painting of a vehicle dashboard surrounding an instrument panel. As will be obvious to those skilled in the art, the improved painting method may be utilized in any industrial or other application wherein a panel or similar wall surface portion is to be maintained unpainted within a surrounding or adjacent wall portion intended to be painted.

It is further to be understood that while in the present embodiment the cutting of the protector element may be effected substantially congruent with the periphery of the panel, the invention comprehends the cutting of the protector element in any desired surrounding relationship to the panel.

Other aspects, objects and advantages of this invention can be obtained from a study of the drawings, the disclosure and the appended claims. The foregoing disclosure of specific embodiments is illustrative of the broad inventive concepts comprehended by the invention.

We claim:

1. The method of painting a wall surface (13) surrounding the panel (11) comprising the steps of:

providing a protector element (14) having a first portion (15) defining a periphery at least as large as the periphery of the panel and a second portion (17) projecting from said periphery of the first portion;

disposing the protector element with the first portion (15) rearwardly of said panel (11) and said second portion (17) projecting therefrom in surrounding relationship to the periphery (18) of said panel (11) to define a shield (22) for preventing paint being applied to the wall surface (13) from being deposited on said panel;

painting said wall surface (13) while permitting a portion of the paint to be deposited on said protector element (14) surrounding the panel (11); and removing said second portion (17) of the protector element (14).

2. The method of painting a wall surface (13) of claim 1 wherein said panel (11) is recessed rearwardly of said wall surface (13) and said protector element second portion (17) projects to forwardly of the wall surface.

3. The method of painting a wall surface (13) of claim 1 including the step of securing the panel (11) to said wall surface through said first portion (15) of the protector element (14).

4. The method of painting a wall surface (13) of claim 1 wherein said removing of said second portion (17) of the protector element includes the step of trimming the protector element about the periphery (18) of said panel (11).

5. The method of painting a wall surface (13) of claim 1 wherein said removing of the second portion (17) of the protector element (14) is effected after the applied paint has dried.

6. The method of painting a wall surface (13) of claim 1 wherein said protector element (14) is formed of a material having the same color as the paint.

7. The method of painting a wall surface (13) of claim 1 wherein said painting step comprises a step of spray painting.

8. The method of painting a wall surface (13) of claim 1 wherein said second portion (17) of the protector element (14) projects forwardly from the first portion (15) about the panel (11).

9. The method of painting a wall surface (13) of claim 1 wherein said removing step comprises a step of cutting said protector element (14), said panel (11) being utilized as a guide in effecting said cutting.

10. The method of painting a wall surface (13) surrounding a panel (11) comprising the steps of:

providing a protector element (14) having a first portion (15) defining a periphery at least as large as the periphery (18) of the panel and a second portion (17) projecting from said periphery of the first portion;

disposing the protector element (14) with the first portion (15) rearwardly of said panel (11) and said second portion (17) projecting therefrom in surrounding relationship to the periphery (18) of said panel;

installing a cover (21) on said second portion (17) of the protector element (14) to overlie the panel (11) and define with said second portion a shield (22) for preventing sprayed paint directed thereagainst from being deposited on said panel;

spray painting said wall surface while permitting overspray to be deposited on said shield surrounding the panel; and removing said shield.

11. The method of painting a wall surface (13) of claim 10 wherein said removing of said cover (21) and second portion (17) of the protector element (14) includes the steps of firstly removing the cover from said second portion and secondly removing the second portion from said first portion (15) about the periphery of said panel (11).

12. The method of painting a wall surface (13) of claim 10 wherein said removing of said cover and second portion (17) of the protector element (14) includes the steps of firstly removing the cover from said second portion and secondly removing the second portion from said first portion (15) about the periphery (18) of said panel (11) by cutting the protector element continuously about said panel periphery.

13. The method of painting a wall surface (13) of claim 10 wherein said cover (21) is removably installed on said second portion (17) of the protector element (14).

14. The method of painting a wall surface (13) of claim 10 wherein said cover (21) is removably snap-fitted on said second portion (17) of the protector element (14).

15. The method of painting a wall surface (13) of claim 10 wherein said cover (21) is mounted to said second portion to extend in forwardly spaced relationship to said panel (11).

16. Structure for use in painting a wall surface (13) surrounding an element (11) to be left unpainted and mounted to said wall surface, said structure comprising:

a base member (14) having a base wall (15) adapted to be secured to said wall surface between said wall surface and said element and defining a peripheral edge portion (24) extending slightly from behind said element, and a spacer (17) extending forwardly from said peripheral edge portion and defining a forward connecting portion (19); and a removable cover (21) carried by said connecting portion (19), said spacer and cover cooperatively defining a protective enclosure (22) about the element (11), said spacer being separable from said base wall along said peripheral edge portion (24) upon completion of painting of the surrounding wall surface (13).

17. The painting structure of claim 16 wherein said edge portion (24) is formed of cuttable material permitting the separation of the spacer (17) from the peripheral portion by a sharp knife (23) extended through the space within the spacer.

18. The painting structure of claim 16 wherein said connecting portion (19) comprises a portion of the spacer (17) and said cover (21) having a cooperating portion (20) defining therewith a releasable snap connection of the cover to the base member (14).

19. The painting structure of claim 16 wherein said base member (14) is formed of a material preselected to have the same color as the color of the paint to be applied to the surrounding wall surface (13).

20. The painting structure of claim 16 wherein said base wall (15) comprises a wall formed of synthetic resin and having a thickness of approximately 1 millimeter.

* * * * *